US012134909B2

(12) United States Patent
Sun et al.

(10) Patent No.: US 12,134,909 B2
(45) Date of Patent: Nov. 5, 2024

(54) OUTDOOR FIXED TENT WITH ASSEMBLY STRUCTURE, BUCKLE MECHANISM, AND ASSEMBLY METHOD FOR FIXED TENT

(71) Applicant: ZHEJIANG JIANSHENG LEISURE PRODUCTS CO., LTD, Zhejiang (CN)

(72) Inventors: Yuanru Sun, Zhejiang (CN); Chao Zeng, Zhejiang (CN); Jian He, Zhejiang (CN)

(73) Assignee: ZHEJIANG JIANSHENG LEISURE PRODUCTS CO., LTD, Zhejiang (CN)

( * ) Notice: Subject to any disclaimer, the term of this patent is extended or adjusted under 35 U.S.C. 154(b) by 189 days.

(21) Appl. No.: 17/968,811

(22) Filed: Oct. 19, 2022

(65) Prior Publication Data

US 2023/0043135 A1 Feb. 9, 2023

(30) Foreign Application Priority Data

Aug. 26, 2022 (CN) ..... 202211031820.8

(51) Int. Cl.
*E04H 15/34* (2006.01)
*E04H 15/18* (2006.01)

(52) U.S. Cl.
CPC ..... *E04H 15/34* (2013.01); *E04H 15/18* (2013.01)

(58) Field of Classification Search
CPC ..... E04H 15/34; E04H 15/18; E04H 15/44
See application file for complete search history.

(56) References Cited

U.S. PATENT DOCUMENTS

| | | | | |
|---|---|---|---|---|
| 6,843,026 | B2 * | 1/2005 | Hoehn | E04B 7/028 52/693 |
| 10,760,296 | B2 * | 9/2020 | Zhu | B41F 16/0073 |
| 11,591,820 | B2 * | 2/2023 | Chu | E04H 15/60 |
| 2003/0159369 | A1 * | 8/2003 | Hoehn | E04B 7/028 52/82 |
| 2020/0181936 | A1 * | 6/2020 | Zhu | B41F 16/0046 |

(Continued)

FOREIGN PATENT DOCUMENTS

| | | | |
|---|---|---|---|
| CN | 204571466 U | * | 8/2015 |
| CN | 205369637 | | 7/2016 |
| CN | 106223650 | | 12/2016 |

(Continued)

*Primary Examiner* — Rodney Mintz
(74) *Attorney, Agent, or Firm* — JCIPRNET

(57) ABSTRACT

An outdoor fixed tent includes a tent roof and a tent frame. The tent roof is installed at an upper part of the tent frame and includes multiple roof tent skeletons and tent beam skeletons. Each roof tent skeleton has one end cooperating with the tent frame and the other end extending towards a center of the tent roof and being inclined upwards. The tent beam skeletons are arranged transversely, and at least one end of each tent beam skeleton cooperates with the corresponding roof tent skeleton. The tent beam skeletons at a same horizontal height are constructed to form a horizontal frame. The tent frame includes multiple stand columns and a cross beam connected between adjacent two stand columns. An installation seat is arranged at an upper end of each stand column. Two ends of the cross beam are respectively installed in cooperation with the corresponding installation seats.

13 Claims, 14 Drawing Sheets

(56) References Cited

U.S. PATENT DOCUMENTS

| | | | | |
|---|---|---|---|---|
| 2021/0396038 | A1 | 12/2021 | Chu et al. | |
| 2023/0383566 | A1* | 11/2023 | Lu | E04H 15/44 |

FOREIGN PATENT DOCUMENTS

| | | | | |
|---|---|---|---|---|
| CN | 205805129 | U | * | 12/2016 |
| CN | 210563727 | U | * | 5/2020 |
| CN | 213509888 | U | * | 6/2021 |
| CN | 216714037 | U | * | 6/2022 |
| KR | 200441914 | Y1 | * | 9/2008 |

* cited by examiner

OUTDOOR FIXED TENT WITH ASSEMBLY STRUCTURE, BUCKLE MECHANISM, AND ASSEMBLY METHOD FOR FIXED TENT

CROSS-REFERENCE TO RELATED APPLICATION

This application claims the priority benefit of China application serial no. 202211031820.8, filed on Aug. 26, 2022. The entirety of the above-mentioned patent application is hereby incorporated by reference herein and made a part of this specification.

BACKGROUND

Technical Field

The present disclosure relates to the technical field of outdoor goods, in particular to an outdoor fixed tent with an assembly structure, a buckle mechanism, and an assembly method for the fixed tent.

Description of Related Art

Outdoor tents are sheds that are supported on the ground to shield from wind, rain, and sunlight and are used for temporary living. An outdoor tent generally includes a tent roof structure and a tent frame structure, where the tent frame usually includes four stand columns and a ring beam for butting the four stand columns. Due to different specifications of tents, the ring beam may include a spliced ring beam or a single ring beam. For packaging, transportation and the like of the tent, especially the tent frame structure is usually designed to be an assemblable structure.

For this, connection structures for connecting the ring beam, the stand columns, and other components are particularly important, while existing connection structures are relatively complicated during assembly. For example, an awning tent is disclosed in Publication No. US20210396038A1; for example, an assemblable multi-functional energy-saving tea kiosk is disclosed in Publication No. CN106223650A; and for example, a tent is disclosed in Publication No. CN205369637U.

The above-mentioned existing designed products are all of an outdoor fixed tent structure. During building of an outdoor fixed tent, the existing fixed tent has relatively strict requirements for builders. Especially due to setting of a frame structure, the positions of stand columns need to be determined first in general. For this, in an existing building process, the stand columns usually need to be independently fixed under the assistance of other tools, which makes an assembly process more troublesome. The auxiliary tools usually need to be configured separately, and if special personnel are employed to build the tent on site, relatively high labor cost is caused. A user needs to independently configure auxiliary tools for building the tent. After the tent is built, such auxiliary tools are usually no longer used, so there is a great waste. In addition, because the overall structure of the product is relatively large, if the stand columns are fixed by pegs in advance, positional deviations easily occur during assembly of cross beams, which affects the overall assembly.

SUMMARY

In view of the above problem, the present disclosure aims to provide an outdoor fixed tent with an assembly structure, a buckle mechanism, and an assembly method for the fixed tent.

By optimizing a structure of tent beam skeletons, the tent beam skeletons may serve as an auxiliary tool during construction of stand columns, which facilitates independent building and use of a product. The buckle mechanism is optimized, which facilitates rapid combination and installation of the components, and improves the convenience of independent building.

The technical problem solved by the present disclosure may be solved by adopting the following technical solutions.

Provided is an outdoor fixed tent with an assembly structure, and the outdoor fixed tent includes a tent roof and a tent frame. The tent roof is installed at an upper part of the tent frame in a covering manner and includes a plurality of roof tent skeletons and a plurality of tent beam skeletons, each roof tent skeleton has one end configured to cooperate with the tent frame and the other end extending towards a center of the tent roof and being inclined upwards, the plurality of tent beam skeletons are arranged transversely, at least one end of each tent beam skeleton is configured to cooperate with the corresponding root tent skeleton, the tent beam skeletons at a same horizontal height are constructed to form a horizontal frame, and there are at least two horizontal frames positioned at different horizontal heights. The tent frame includes a plurality of stand columns and a cross beam connected between every two adjacent stand columns, an installation seat is arranged at an upper end of each stand column, and two ends of the cross beam are respectively installed in cooperation with the corresponding installation seats.

Any four of the tent beam skeletons or any four of the tent beam skeletons positioned in the same horizontal frame may be combined to form an auxiliary stand column bracket.

Each tent beam skeleton has one end provided with a first assembly portion and an end part provided with a second assembly portion, the first assembly portion may be butted and matched with the second assembly portion at the end part of another tent beam skeleton, the four tent beam skeletons are correspondingly butted and matched to form the auxiliary stand column bracket, stand column butt-joint holes are further correspondingly formed in the tent beam skeletons, a stand column base is arranged at a bottom portion of each stand column, a stand column installation hole is formed in the stand column base, and the stand column installation hole may be fixedly matched with the corresponding stand column butt-joint hole via a fastener.

The installation seat includes a first tent rod bracket and a hanging seat configured to be installed in cooperation with the cross beam, and the cross beam is in hanging cooperation with the hanging seat via a hanging frame.

The cross beam includes an outer cross beam and an inner cross beam, the outer cross beam includes a first outer cross beam unit and a second outer cross beam unit, the inner cross beam includes a central inner cross beam and side inner cross beams positioned at two ends of the central inner cross beam, the first outer cross beam unit and the second outer cross beam unit are butted and matched with each other, the central inner cross beam is arranged correspondingly with the butt-joint position of the first outer cross beam unit and the second outer cross beam unit as a center, and the two ends of the central inner cross beam are respectively matched with one ends of the side inner cross beams.

The hanging frame includes a hook portion, a main body portion, and a bottom support portion, the hook portion is configured to be in hanging cooperation with the hanging seat, the main body portion is configured to be fixedly matched with the corresponding stand column or/and the cross beam, and the bottom support portion is configured to support the cross beam.

An alignment hole is formed in the main body portion, outer installation holes are formed in the first outer cross beam unit and the second outer cross beam, inner installation holes are formed in the side inner cross beams, stand column installation holes are formed in the stand columns, and the outer installation holes, the inner installation holes, the alignment holes, and the stand column installation holes are fixedly matched via fasteners.

The first tent rod bracket includes a first bracket rod and a first inclined groove positioned in an upper part of the first bracket rod.

The outdoor fixed tent with the assembly structure further includes second tent rod brackets, each second tent rod bracket includes a bracket seat and a second inclined groove positioned in an upper part of the bracket seat, a bottom portion of the bracket seat is configured to be fixedly matched with the cross beam, and the second tent rod bracket is positioned at a butt-joint position of the first outer cross beam unit and the second outer cross beam unit.

The roof tent skeletons are diagonal tent skeletons, the diagonal tent skeletons are radiated from the center of the tent roof to the stand columns, and the roof tent skeletons are configured to cooperate with the first inclined grooves.

The roof tent skeletons further include middle tent skeletons, the middle tent skeletons are radiated from the center of the tent roof to middles of the cross beams, and the middle tent skeletons are configured to cooperate with the second inclined grooves.

There are four tent beam skeletons in a single horizontal frame, and two ends of each tent beam skeleton are respectively configured to be cooperatively fixed to the two adjacent diagonal tent skeletons.

There are eight tent beam skeletons in a single horizontal frame, and each tent beam skeleton has one end configured to be cooperatively fixed to the adjacent diagonal tent skeleton and the other end configured to be cooperatively fixed to the adjacent middle tent skeleton.

A central tent frame is arranged in the center of the tent roof, and an upper tent roof is cooperatively arranged on the central tent frame via vertical rods.

The central tent frame includes assembly frames and butt-joint frames, a third assembly portion is arranged at an end part of each assembly frame, and the diagonal tent skeletons, the vertical rods, and the butt-joint frames are cooperatively fixed to the third assembly portions.

A fourth assembly portion is arranged on an outer side of the middle of each assembly frame, and the fourth assembly portion is configured to be cooperatively fixed to an end part of the corresponding middle tent skeleton.

The upper tent roof includes a central tent roof cover, a plurality of upper tent roof skeletons extending towards a periphery from the central tent roof cover, and upper tent beam skeletons installed at extension ends of the adjacent upper tent roof skeletons, two ends of each upper tent beam skeletons are installed in cooperation with the adjacent upper tent roof skeletons, and upper ends of the vertical rods are fixedly matched with the middles of the upper tent roof skeletons.

A buckle mechanism for an outdoor fixed tent is provided, and the buckle mechanism is used for the outdoor fixed tent with an assembly structure and includes a first component and a second component. The first component and the second component are cooperatively installed via the buckle mechanism, the buckle mechanism includes a buckle piece and a buckle seat, the first component is a rod piece with a hollow inner cavity structure, the buckle piece is cooperatively arranged in an inner cavity at an end part of the first component or a position adjacent to the end part of the first component, the buckle seat is arranged on the second component, and a lock hole configured to be fixed to the buckle piece is formed in the buckle seat.

When there is one lock hole in the buckle seat, the buckle piece matched with a corresponding buckle adopts a single-bean spring clamp bean. When there are two lock holes in the buckle seat, the buckle piece matched with the corresponding buckle adopts a dual-bean spring clamp bean.

The buckle piece is fixedly matched with the end part of the first component, the buckle piece adopts an inverted L-shaped clamp plate, and the buckle piece is buckled into the lock hole from top to bottom.

The buckle piece is fixedly matched with the end part of the first component, the buckle piece adopts a T-shaped buckle, and the buckle piece is buckled into the lock hole from top to bottom.

The buckle piece is fixedly matched with the end part of the first component, the buckle piece adopts a locking plate, the lock hole in the buckle seat adopts a structure of a support groove, the support groove is configured to support the first component, and the locking plate and the second component are fixedly installed via a fastener.

A first assembly portion and a second assembly portion are butted and matched by means of the buckle mechanism.

A diagonal tent skeleton, a vertical rod, and a butt-joint frame are butted and matched by means of the buckle mechanism.

A fourth assembly portion is configured to be butted and matched with an end part of a middle tent skeleton by means of the buckle mechanism.

A tent beam skeleton is configured to be butted and matched with the diagonal tent skeleton or the middle tent skeleton by means of the buckle mechanism.

Two ends of an upper tent beam skeleton are respectively butted and matched with adjacent upper tent roof skeletons by means of buckle mechanisms.

An assembly method for an outdoor fixed tent adopting buckle mechanisms includes the following steps. Step S1: construction of auxiliary stand column brackets: constructing a same number of auxiliary stand column brackets by the number of corresponding stand columns according to a specification of an outdoor fixed tent needing to be constructed, where four tent beam skeletons are selected for a single auxiliary stand column bracket, and first assembly portions and second assembly portions are butted via buckle mechanisms to complete the installation of the auxiliary stand column brackets. Step S2: fixation of the stand columns: completing fixed installation of stand column bases at bottoms of the stand columns and the auxiliary stand column brackets via fasteners, and placing the plurality of stand columns in corresponding positions according to the corresponding specification of the outdoor fixed tent. Step S3: construction of cross beams: fixedly installing a single cross beam, respectively fixing outer cross beams and inner cross beams in a butted manner, fixedly installing hanging frames on the cross beams, allowing the cross beams to be in hanging cooperation with hanging seats in installation seats on the stand columns via the hanging frames, and fixedly installing the cross beams and the stand columns via fasteners. Step S4: construction of a tent roof, including: step S41: restoration of the tent beam skeletons: removing the fixed installation of the auxiliary stand column brackets and the stand column bases, and removing buckle mechanisms between the auxiliary stand column brackets to restore the auxiliary stand column brackets to the independent tent beam skeletons; and step S42: fixing the corresponding tent beam skeletons and roof tent skeletons in a butted manner via buckle mechanisms according to the specification of the outdoor fixed tent to complete the construction of the tent roof. Step S5: construction of the tent roof and a tent frame: fixing the roof tent skeletons in the tent roof to first tent rod brackets or/and second tent rod brackets via fasteners to complete the construction. Step S6: construction of tent roof plates: covering the tent roof with the tent roof plates at corresponding positions and performing fixation via fasteners to complete construction of the whole tent.

The step S4 further includes construction of an upper tent roof, where a central tent frame is constructed, and third assembly portions are respectively fixedly matched with diagonal tent skeletons, vertical rods, and butt-joint frames via buckle mechanisms; and upper tent roof skeletons are butted and matched with upper tent beam skeletons via buckle mechanisms.

Compared with the prior art, the present disclosure has the following beneficial effects. By optimizing the structure of the tent beam skeletons, the tent beam skeletons may serve as the auxiliary tool during construction of the stand columns, and product components may be automatically combined to form the auxiliary tool for use in construction, which facilitates independent building and use of a product, and reduces building cost of the product; the buckle mechanism is optimized, which facilitates rapid combination and installation of the components, and improves the convenience of independent building; and the components are of an independently assemblable structure, which makes the product convenient to independently build.

The characteristics of the present disclosure may be clearly understood with reference to the drawings and the detailed description of the preferred implementations below.

DESCRIPTION OF THE EMBODIMENTS

Figure 1:
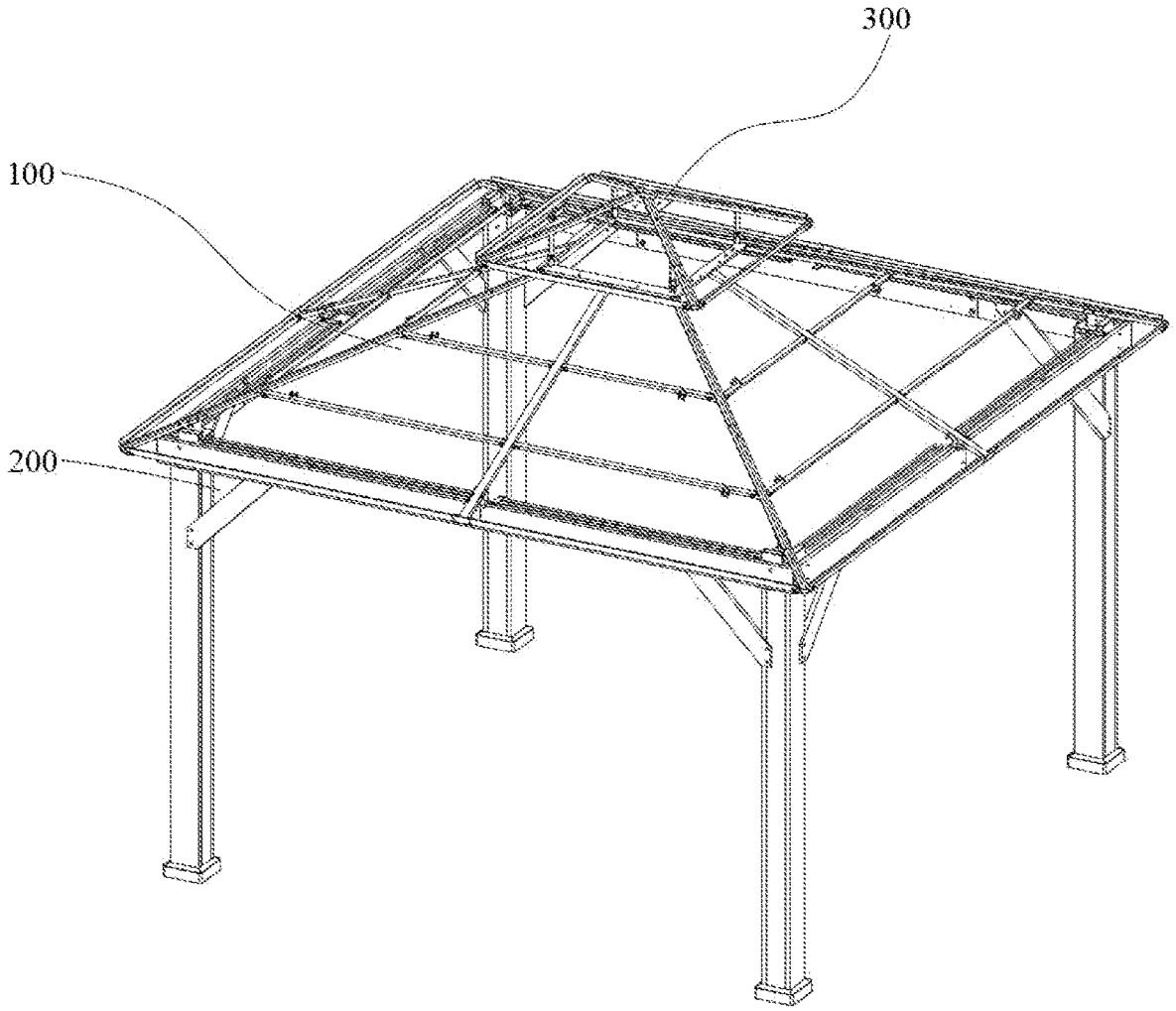
FIG. 1 is a schematic diagram of an overall structure of an outdoor fixed tent in the present disclosure.
Figure 2:
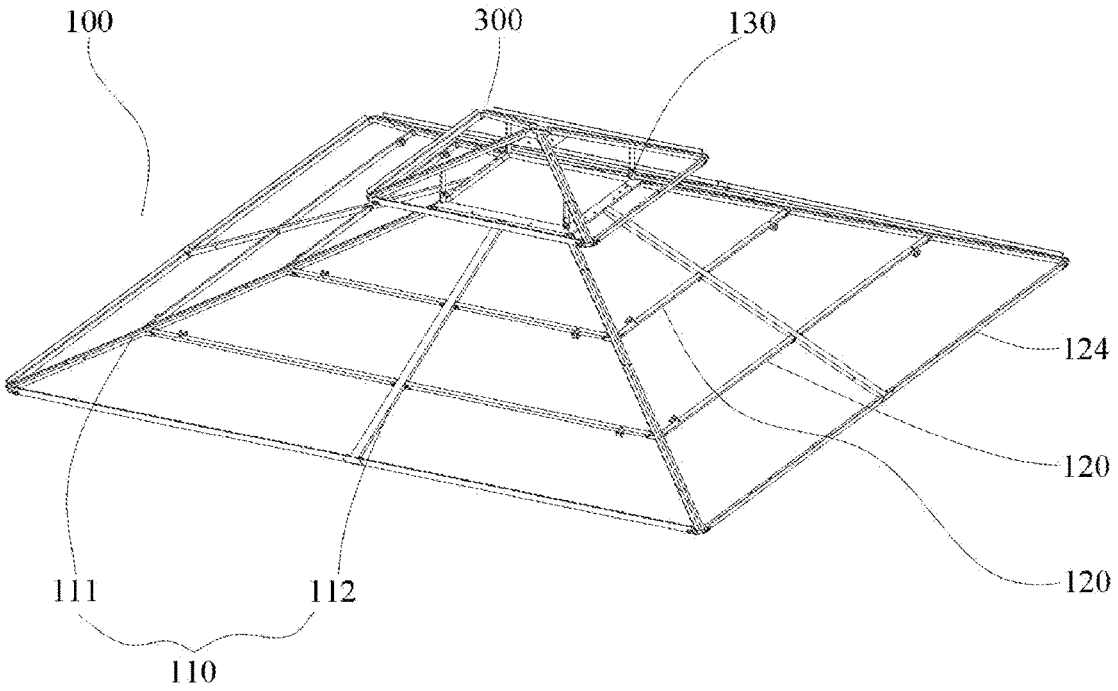
FIG. 2 is a schematic structural diagram of a tent roof in the present disclosure.
Figure 3:
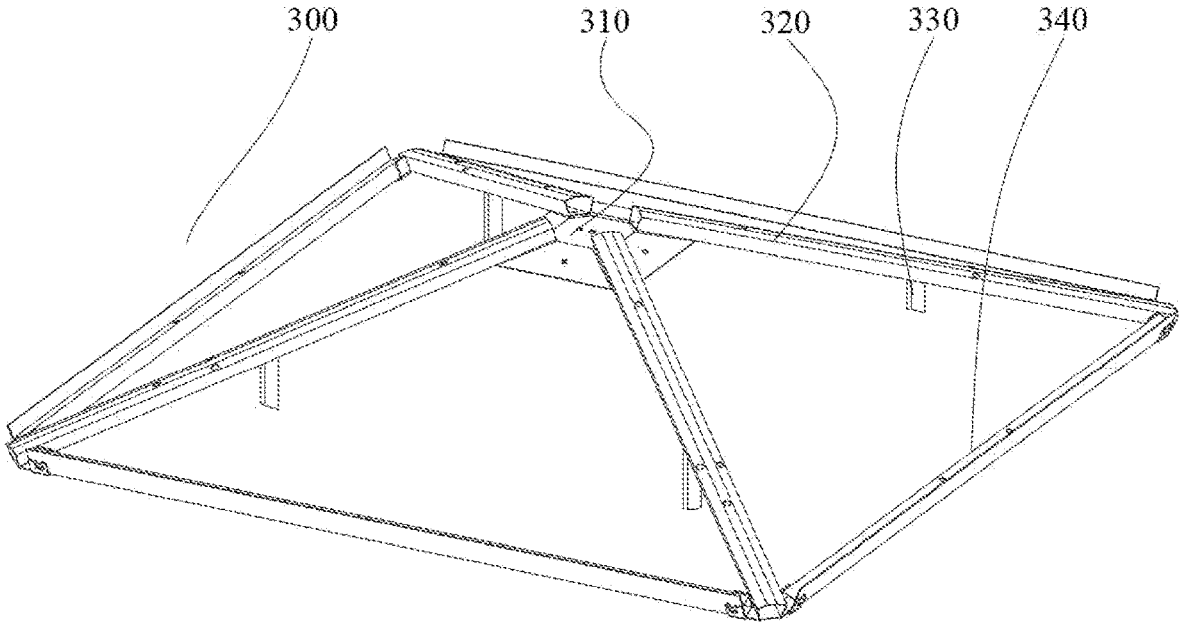
FIG. 3 is a schematic structural diagram of an upper tent roof in the present disclosure.
Figure 4:
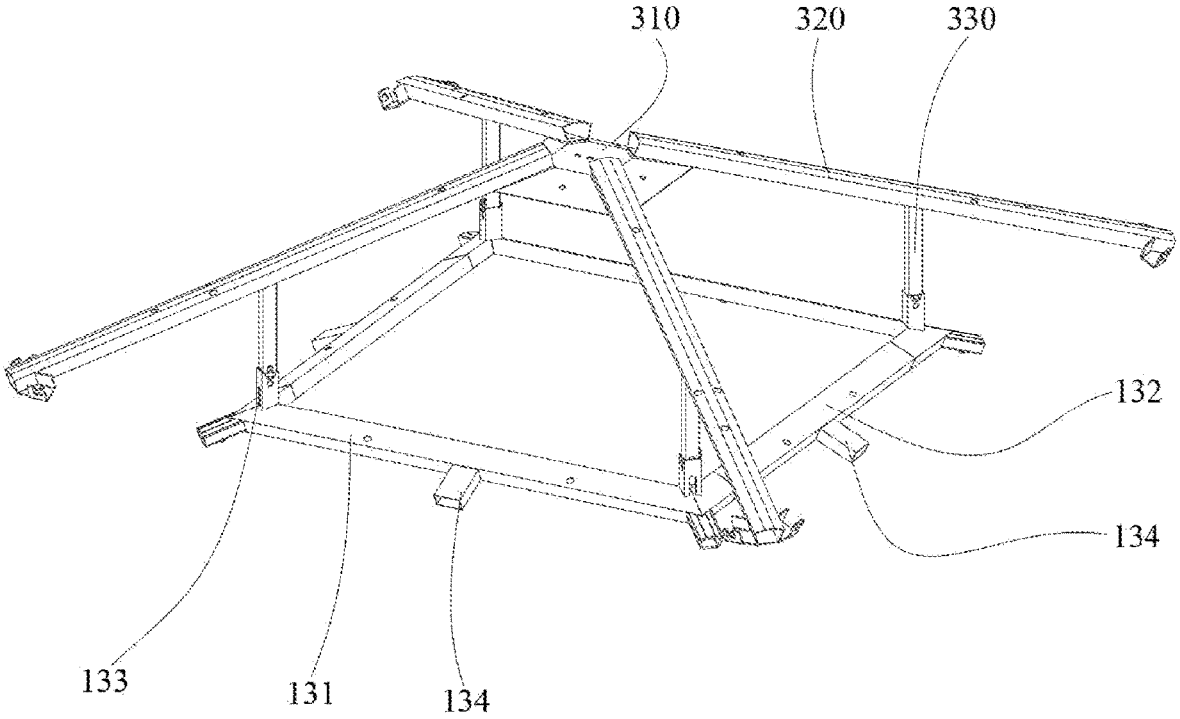
FIG. 4 is a schematic diagram of an installation structure of the upper tent roof and a central tent frame in the present invention.
Figure 5:
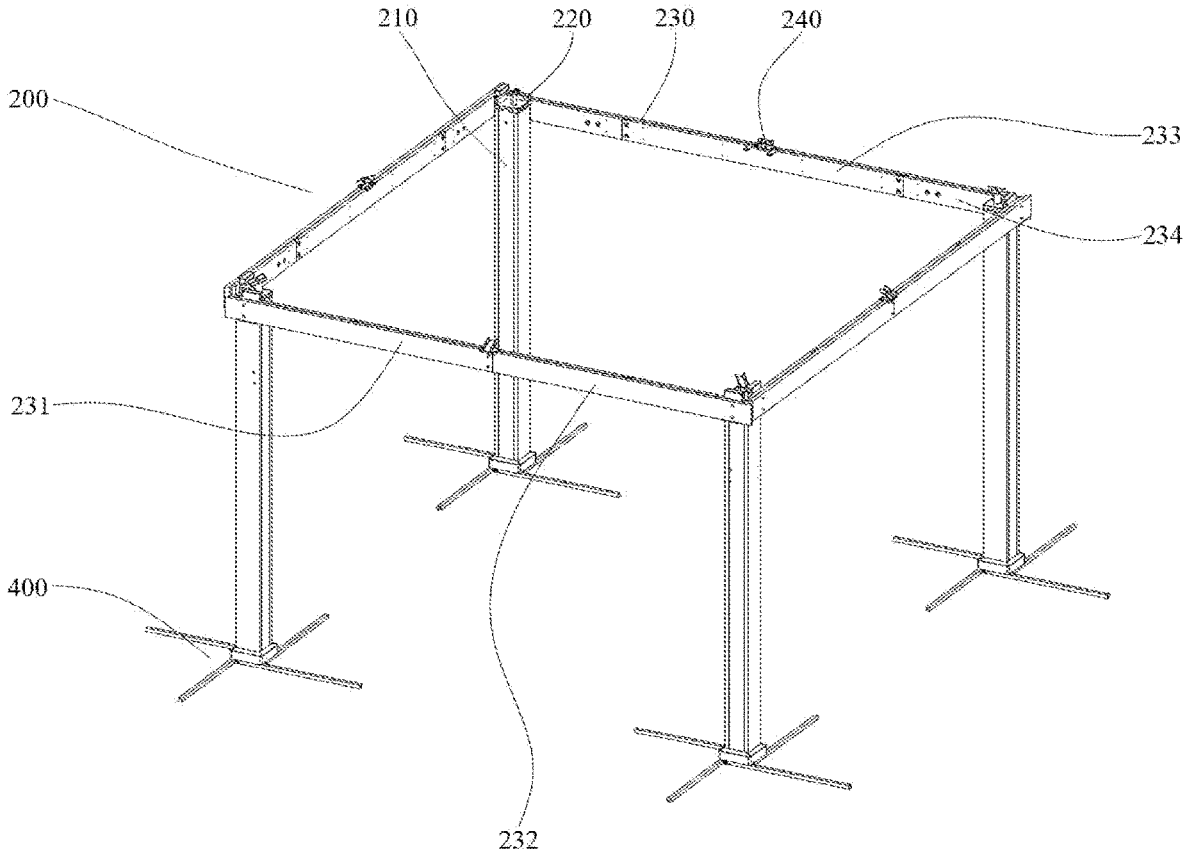
FIG. 5 is a second schematic structural diagram of a tent frame in the present disclosure.
Figure 6:
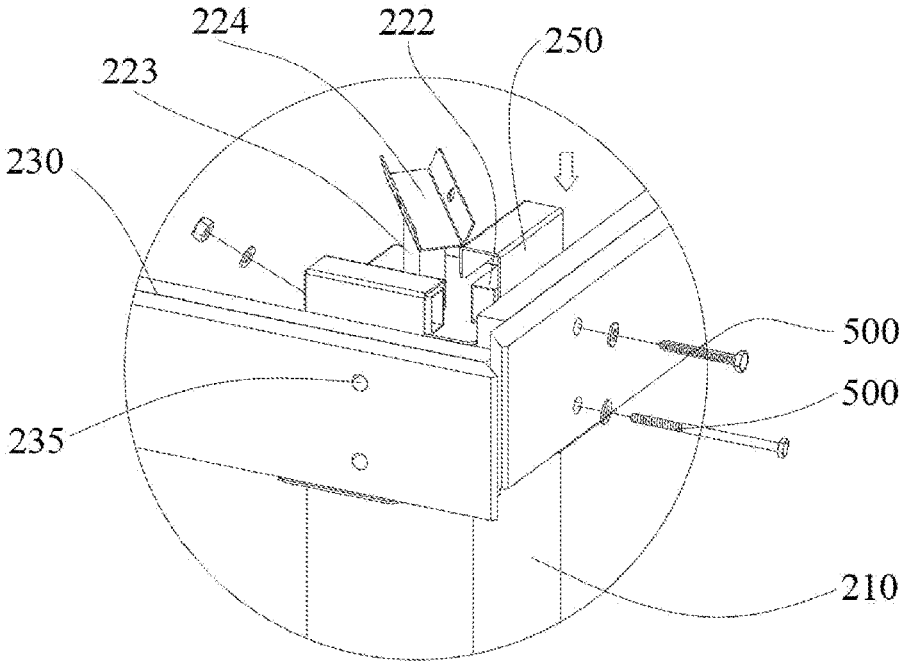
FIG. 6 is a schematic diagram of an installation structure of a cross beam and a stand column in the present disclosure.
Figure 7:
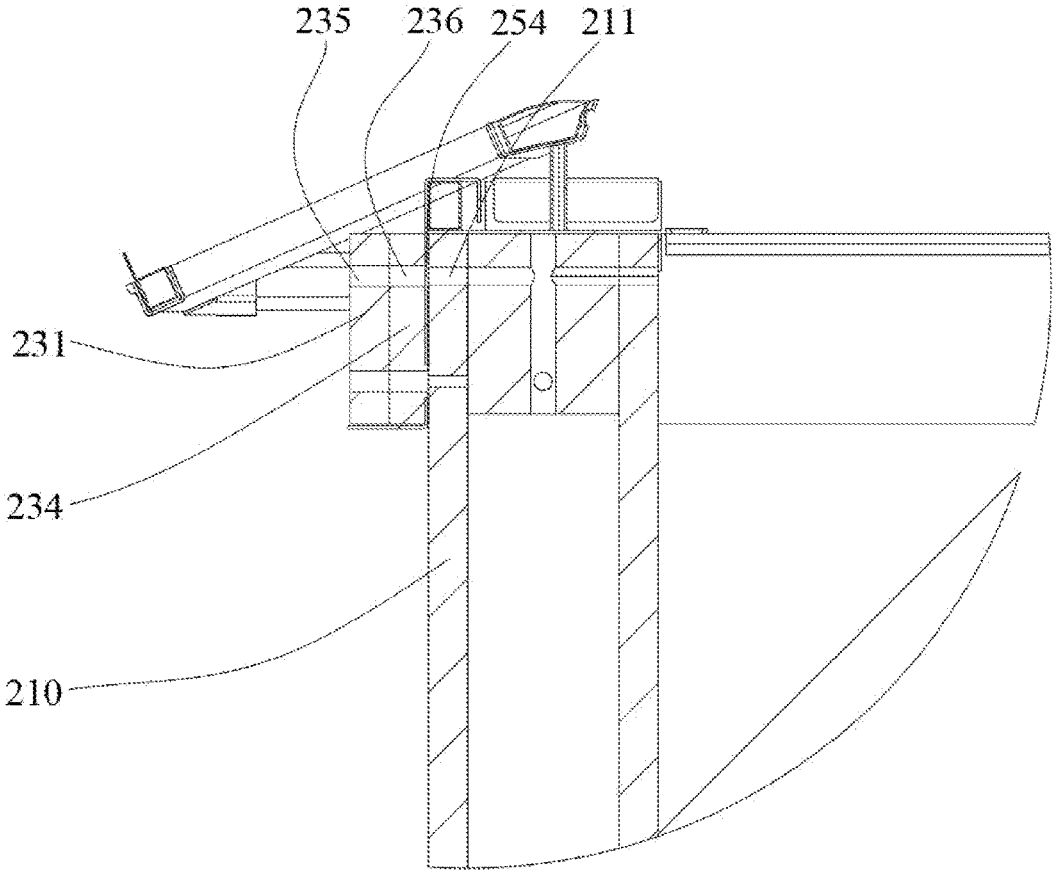
FIG. 7 is a schematic diagram of a cross-sectional structure of the cross beam and the stand column in the present disclosure.
Figure 8:
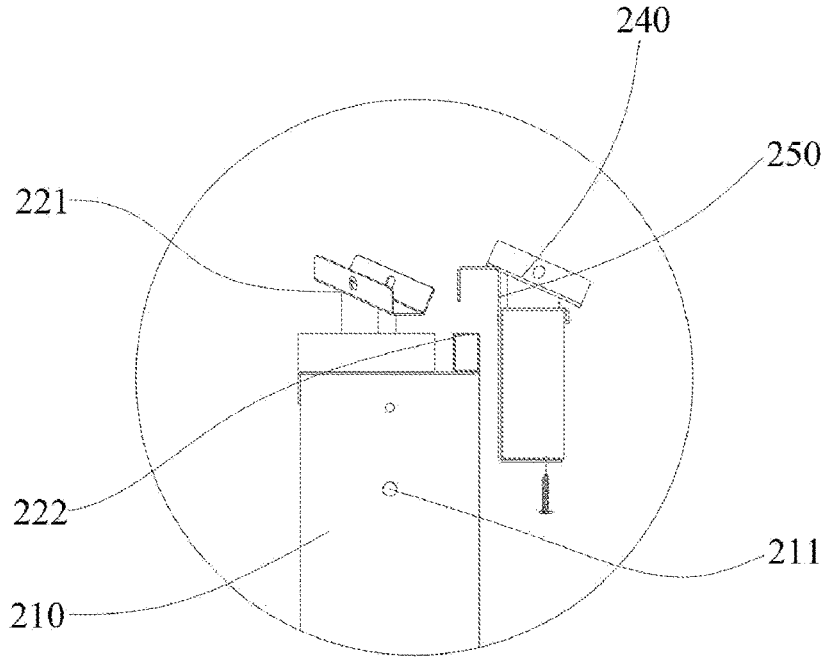
FIG. 8 is a schematic diagram of an installation structure of a hanging seat and a hanging frame in the present disclosure.
Figure 9:
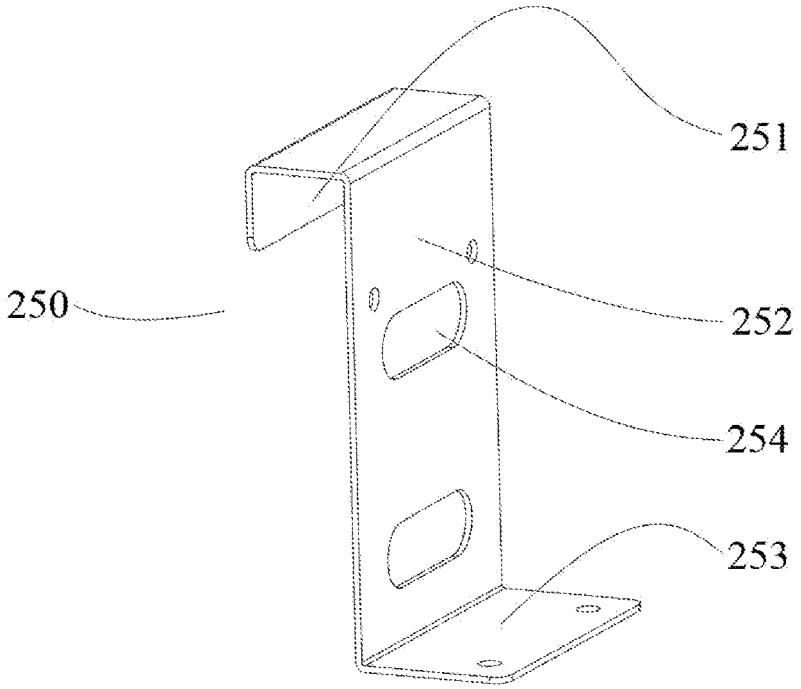
FIG. 9 is a schematic structural diagram of the hanging frame in the present disclosure.
Figure 10:
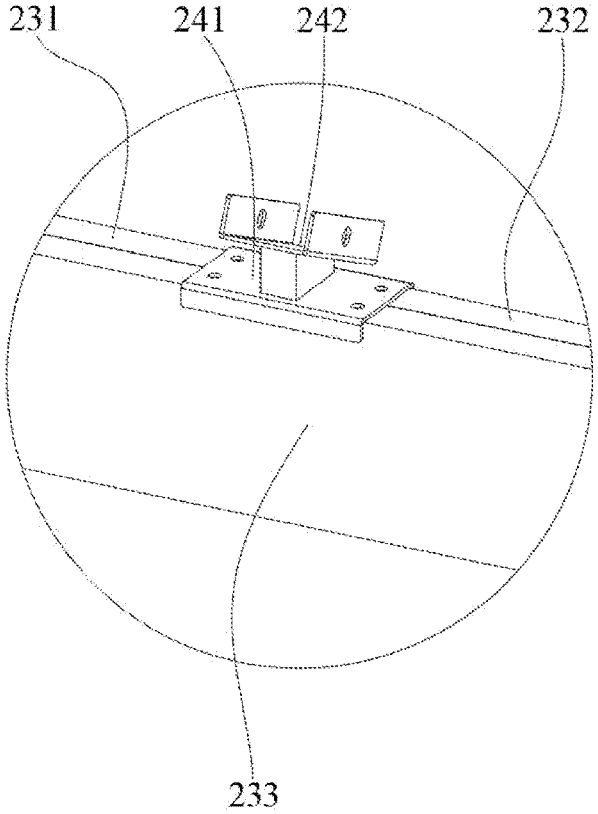
FIG. 10 is a schematic diagram of an installation structure of a second tent rod bracket and the cross beam in the present disclosure.
Figure 11:
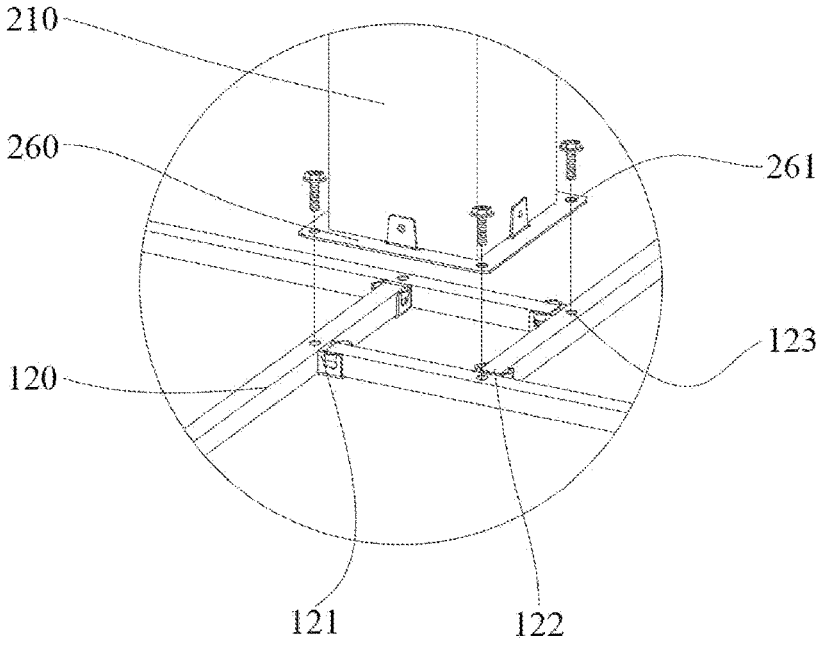
FIG. 11 is a schematic diagram of a matched installation structure of the stand column and an auxiliary stand column bracket in the present disclosure.

In order to make the technical means, creative features, achievement goals, and effects achieved by the present disclosure easy to understand, the present disclosure will be further described below in conjunction with the specific drawings.

It should be noted that all the directional indications (such as up, down, left, right, front, back, . . . ) in the embodiments of the present disclosure are only used to explain the relative positional relationship, motion situation and the like between the components under a specific attitude (as shown in the drawings), and if the specific attitude changes, then the directional indications also change accordingly. In addition, the descriptions of "first", "second" and the like in the present disclosure are used for the purpose of description only, and cannot be construed as indicating or implying their relative importance or implicitly indicating the number of technical features indicated. Thus, the features defined by "first" and "second" may explicitly or implicitly include at least one of the features.

Embodiment 1

As shown FIG. 1 to FIG. 24, this embodiment provides an outdoor fixed tent with a convenient assembly structure, and the outdoor fixed tent includes a tent roof 100 and a tent frame 200. The tent roof 100 is installed at an upper part of the tent frame 200 in a covering manner, the tent roof 100 includes a plurality of roof tent skeletons 110 and a plurality of tent beam skeletons 120, each roof tent skeleton 110 has one end configured to cooperate with the tent frame 200 and the other end extending towards the center of the tent roof 100 and being inclined upwards, the plurality of tent beam skeletons 120 are arranged transversely, at least one end of each tent beam skeleton is configured to cooperate with the corresponding root tent skeleton 110, the tent beam skeletons 120 at the same horizontal height are constructed to form a horizontal frame, and there are at least two horizontal frames positioned at different horizontal heights. The tent frame 200 includes a plurality of stand columns 210 and a cross beam 230 connected between every two adjacent stand columns 210, an installation seat 220 is arranged at an upper end of each stand column 210, and two ends of the cross beam 230 are respectively installed in cooperation with the corresponding installation seats 220.

According to specification requirements, the number of stand columns 210 in the tent frame 200 may be at least two, usually four, six, eight, etc. A rectangular frame structure is formed by cooperative construction of the cross beams 230 and the stand columns 210, and the number of stand columns 210 corresponding to the tent roof 100 is cooperatively set. If there are two stand columns, the tent is usually a single-sided tent with another side surface fixed to a wall.

Based on the above structure, the preferred number of stand columns 210 is four, where the number of cross beams 230 correspondingly matched with the stand columns 210 is also four, and the number of roof tent skeletons 110 in the tent roof 100 may be four or eight. According to different specifications, eight roof tent skeletons 110 are preferably used in this embodiment, and are divided into four diagonal tent skeletons 111 and four middle tent skeletons 112. The corresponding number of tent beam skeletons 120 is sixteen, where the number of tent beam skeletons 120 in the same horizontal frame is eight, and in two horizontal frames with different horizontal heights, the lengths of the number of tent beam skeletons 120 positioned at different horizontal heights are different. In addition, side tent beam skeletons 124 may be butted with outermost ends of the roof tent skeletons 110, where the side tent beam skeletons 124 may be of the same structure as the tent beam skeletons 120, but have different length specification, and independent design may also be made to improve the aesthetic feeling of appearance as needed.

In combination with the above-mentioned embodiment, a first assembly portion 121 is arranged on one side of each tent beam skeleton 120, a second assembly portion 122 is arranged at an end part of each tent beam skeleton 120. The position of the corresponding first assembly portion 121 in any one tent beam skeleton 120 is the same as the position of the second assembly portion 120, which facilitates universal buckle cooperation between the tent beam skeletons 120, and ensures that any four tent beam skeletons 120 may be combined to form an auxiliary stand column bracket 400. In another embodiment, preferably any four tent beam skeletons 120 positioned in the same horizontal frame are combined to form the auxiliary stand column bracket 400.

In combination with the above, a construction structure of the auxiliary stand column bracket 400 is as follows. The first assembly portion 121 is butted and matched with the second assembly portion 122 at the end part of another tent beam skeleton 120, the first and second assembly portions are cooperatively fixed by means of a buckle mechanism 600, and the four tent beam skeletons 120 are correspondingly butted and matched to form the auxiliary stand column bracket 400. A spacing between the first assembly portion 121 and the second assembly portion 122 is designed to be matched with the corresponding specification of a stand column base 260 in each stand column 210, such that the auxiliary stand column bracket 400 forms a rectangular frame after the middle thereof is butted with the first assembly portion 121 and the second assembly portion 122. The other end of each tent beam skeleton 120 extends outwards. A stand column butt-joint hole 123 is further correspondingly formed in each tent beam skeleton 120, the stand column base 260 is arranged at the bottom of each stand column 210, a stand column installation hole 261 is formed in the stand column base 260, and the stand column installation hole 261 may be fixedly matched with the stand column butt-joint hole 123 via a fastener 500. The structural design is optimized, such that the tent beam skeletons 120 may be constructed to form the auxiliary stand column bracket 400, and the fixation of the stand column base 260 is facilitated. Due to the design of the length specification of the tent beam skeletons 120, the stand column base 260 has good grip and support force. In addition, according to the position requirement of the stand columns 210, better laying may be carried out, which facilitates the installation of the whole tent.

The installation seat 220 is preferably arranged on the top of each stand column 210, the installation seat 220 includes a first tent rod bracket 221 and a hanging seat 222 configured to be installed in cooperation with the cross beam 230, the first tent rod bracket 221 includes a first bracket rod 223 and a first inclined groove 224 positioned in an upper part of the first bracket rod 223, and a groove cavity in the first inclined groove 224 is matched with an end of each diagonal tent skeleton 111 close to the exterior, where an end part of the diagonal tent skeleton 111 extends outwards and may extend outwards in combination with butt-joint of the side tent beam skeleton 124 to form an eave roof. The bottom of the first bracket rod 223 is usually fixed to the installation seat 220 integrally or by welding, and the installation seat 220 is installed and fixed or directly welded and fixed to the top of the stand column 210 via a fastener 500. The cross beam 230 is in hanging cooperation with the hanging seat 222 via a hanging frame 250, where the hanging seat 222 is positioned at an edge or a position close to the edge of the installation seat 220, which facilitates hanging cooperation of the cross beam 230, hanging seats are usually positioned on two outer side edges and are respectively in hanging cooperation with the adjacent cross beams 230 configured to be arranged in cooperation with the corresponding stand columns 210, and the hanging seat 222 and the installation seat 220 are of an integrally fixed or welding-based fixed structure.

A component in hanging cooperation with the hanging seat 222 is the hanging frame 250, the hanging frame 250 is preferably an independent component, and the hanging frame is assembled and fixed together with the stand column 210 or the cross beam 230 first, preferably is correspondingly fixedly installed together with the cross beam 230 first, where the hanging frame 250 includes a hook portion 251, a main body portion 252, and a bottom support portion 253, the hook portion 251 is configured to be in hanging cooperation with the hanging seat 222, the main body portion 252 is configured to be fixedly matched with the stand column 210 or/and the cross beam 230, and the bottom support portion 253 is configured to support the cross beam 230. An alignment hole 254 is formed in the main body portion 252, outer installation holes 235 are formed in a first outer cross beam unit 231 and a second outer cross beam unit 232, inner installation holes 236 are formed in side inner cross beams 234, stand column installation holes 211 are formed in the stand columns 210, and the outer installation holes 235, the inner installation holes 236, the alignment holes 254, and the stand column installation holes 211 are fixedly matched via fasteners 500, where the alignment hole 254 is designed to be of a racetrack hole structure, which facilitates hole alignment, the fasteners 500 may be screws, bolts, etc., and the correspondingly installed fasteners 500 are selected according to the positions of required installation holes.

By means of the cooperation of the hanging frame 250 and the hanging seat 222, the alignment installation of the cross beam 230 and the stand column 210 is facilitated. After formation of the hanging cooperation, the installation of the holes is also facilitated, such that the cross beam 230 and the stand column 210 are more convenient to fix, and the construction of the tent frame 200 is facilitated.

The cross beam 230 is divided into a plurality of components. During assembly of the stand column 210, a single cross beam 230 may be assembled first. The cross beam 230 includes an outer cross beam and an inner cross beam, the outer cross beam includes the first outer cross beam unit 231 and the second outer cross beam unit 232, and the inner cross beam includes a central inner cross beam 233 and the side inner cross beams 234 positioned at two ends of the central inner cross beam 233. The first outer cross beam unit 231 and the second outer cross beam unit 232 are butted and matched, the central inner cross beam 233 is correspondingly arranged with a butt-joint position of the first outer cross beam unit 231 and the second outer cross beam unit 232 as the center, and the two ends of the central inner cross beam 233 are respectively matched with one ends of the side inner cross beams 234. The first outer cross beam unit 231 and the second outer cross beam unit 232 are butted by means of step dislocation and the butt-joint position thereof is fixedly installed via a fastener 500, the two ends of the central inner cross beam 233 are respectively fixed to the first outer cross beam unit 231 and the second outer cross beam unit 232 via fasteners 500, and the two ends of the central inner cross beam 233 are respectively butted with the side inner cross beams 234 by means of step dislocation and butt-joint positions thereof are fixed via fasteners 500. The outer installation hole 235, the inner installation hole 236, the alignment hole 254, and the stand column installation hole 211 are integrally fixed in a penetration manner at end parts of the first outer cross beam unit 231 and the second outer cross beam unit 232 to complete the fastening installation of the whole cross beam 230.

In one of the embodiments, the relatively small outdoor fixed tent is used, the roof tent skeletons 110 are four diagonal tent skeletons 111, the diagonal tent skeletons 111 are radiated from the center of the tent roof 100 to the positions of the stand columns 210, the roof tent skeletons 110 are configured to cooperate with the first inclined grooves 224, the number of tent beam skeletons 120 in a single horizontal frame is four, two ends of each tent beam skeleton 120 are respectively configured to be cooperatively fixed to the two adjacent diagonal tent skeletons 111 to complete the frame construction of the whole tent roof 100, and then roof plates are laid to complete the laying of the tent roof 100, where the roof plates may be wooden boards, sheet iron plates, plastic boards, solar panels, glass plates, etc.

Based on the above, the outdoor fixed tent further includes second tent rod brackets 240. Each second tent rod bracket 240 includes a bracket seat 241 and a second inclined groove 242 positioned in an upper part of the bracket seat 241, the bottom of the bracket seat 241 is configured to be fixedly matched with the cross beam 230, and the second tent rod bracket 240 is positioned at the butt-joint position of the first outer cross beam unit 231 and the second outer cross beam unit 232. The bottom of the bracket seat 241 is usually preferably of an inverted "U"-shaped structure, the fixation of the cross beam 230 is further strengthened by means of wrapping of two side edges, and meanwhile, the bracket seat 241 is fastened and installed together with an upper surface of the cross beam 230 via a fastener 500. The installation position of the second tent rod bracket 240 is optimized to ensure that the butt-joint position of the first outer cross beam unit 231 and the second outer cross beam unit 232 is more fastened, and a structure of the second inclined groove 242 is arranged to facilitate the cooperation with the middle tent skeleton 112.

In combination with the above, in one of the embodiments, this type of tent is medium or relatively large in size, and is designed to be of an eight-skeleton structure. Meanwhile, the cross beam 230 is preferably of a segmented combined cross beam structure, which may increase the overall strength and reduce the overall packaging volume. The roof tent skeletons 110 include the four diagonal tent skeletons 111 and the four middle tent skeletons 112, the middle tent skeletons 112 are radiated from the center of the tent roof 100 to the middles of the cross beams 230, and the middle tent skeletons 112 are configured to cooperate with the second inclined grooves 242. The number of tent beam skeletons 120 in a single horizontal frame is eight, one end of each tent beam skeleton 120 is configured to be cooperatively fixed to the adjacent diagonal tent skeleton 111, the other end thereof is configured to be cooperatively fixed to the adjacent middle tent skeleton 112 to complete the frame construction of the whole tent roof 100, and then the roof plates are laid to complete the laying of the tent roof. The roof plates may be the wooden boards, the sheet iron plates, the plastic boards, the solar panels, the glass plates, etc.

In combination with the above, in one of the embodiments, a central tent frame 130 is arranged in the center of the tent roof 100, an upper tent roof 300 is cooperatively arranged on the central tent frame 130 via vertical rods 330, and the tent roof is designed to be of a double-roof structure, which improves the aesthetic feeling of appearance of the tent roof 100. The central tent frame 130 includes assembly frames 131 and butt-joint frames 132, third assembly portions 133 are arranged at end parts of the assembly frames 131, and the diagonal tent skeletons 111, the vertical rods 330, and the butt-joint frames 132 are all cooperatively fixed to the third assembly portions 133. Each third assembly portion 133 includes a vertical rod seat configured to be butted and matched with the vertical rod 330, a tent skeleton seat configured to be butted and matched with the diagonal tent skeleton 111, and a frame seat configured to be butted and matched with the butt-joint frame 132, the installation cooperation of the components is respectively realized by three-position arrangement, and a butt-joint structure thereof preferably adopts the buckle mechanism 600 to realize the fixed installation. The upper tent roof 300 includes a central tent roof cover 310, a plurality of upper tent roof skeletons 320 extending to the periphery from the central tent roof cover 310, and upper tent beam skeletons 340 installed at extension ends of the adjacent upper tent roof skeletons 320. Two ends of each upper tent beam skeleton 340 are respectively installed in cooperation with the adjacent upper tent roof skeletons 320, and upper ends of the vertical rods 330 are fixedly matched with the middles of the upper tent roof skeletons 320. The upper tent roof 300 is also configured to be cooperatively provided with roof plates to realize top coverage.

Preferably, a fourth assembly portion 134 is arranged on an outer side of the middle of the assembly frame 131, the fourth assembly portion 134 is configured to be cooperatively fixed to an end part of the middle tent skeleton 112, and a butt-joint structure thereof preferably adopts the buckle mechanism 600 to realize the fixed installation. The fourth assembly portion 134 is also arranged on an outer side of the middle of the butt-joint frame 132, the fourth assembly portion 134 is configured to be cooperatively fixed to the end part of the middle tent skeleton 112, and the butt-joint structure thereof preferably adopts the buckle mechanism 600 to realize the fixed installation.

According to the present disclosure, by optimizing a structure of the tent beam skeletons 120, the tent beam skeletons may serve as an auxiliary tool during construction of the stand columns 210, and product components may be automatically combined to form the auxiliary tool for use in construction, which facilitates independent building and use of a product, and reduces building cost of the product.

Embodiment 2

Based on Embodiment 1, as shown in FIG. 14 to FIG. 24, this embodiment discloses a convenient buckle mechanism for an outdoor fixed tent, and the buckle mechanism is used for the outdoor fixed tent with a convenient assembly structure and includes a first component and a second component. The first component and the second component are cooperatively installed via the buckle mechanism 600. The buckle mechanism 600 includes a buckle piece 610 and a buckle seat 620, the first component is a rod piece with a hollow inner cavity structure, the buckle piece 610 is cooperatively arranged in an inner cavity at an end part or a position close to the end part of the first component, the buckle seat 620 is arranged on the second component, and a lock hole 630 configured to be fixed to the buckle piece 610 is formed in the buckle seat 620.

In combination with the above structure, the first and second components may be corresponding components needing to be butted and fixed in the diagonal tent skeletons 111, the middle tent skeletons 112, the tent beam skeletons 120, the assembly frames 131, the butt-joint frames 132, the vertical rods 330, the upper tent roof skeletons 320, and the upper tent beam skeletons 340, and the components need to be fixedly installed via the buckle mechanism 600 according to the assembly requirement. A cooperative relationship between the above components is as follows. The first assembly portions 121 and the second assembly portions 122 are butted and matched. The diagonal tent skeletons 111, the vertical rods 330, and the butt-joint frames 132 are butted and matched with the third assembly portions 133. The fourth assembly portions 134 are configured to be butted and matched with the end parts of the middle tent skeletons 112. The tent beam skeletons 120 are configured to be butted and matched with the diagonal tent skeletons 111 or the middle tent skeletons 112. Two ends of each upper tent beam skeleton 340 are respectively butted and matched with the adjacent upper tent roof skeletons 320.

In one of the embodiments, as shown in FIGS. 14 to 19, when there is one lock hole 630 in the buckle seat 620, the buckle piece 610 matched with a corresponding buckle adopts a single-bean spring clamp bean. When there are two lock holes 630 in the buckle seat 620, the buckle piece 610 matched with the corresponding buckle adopts a dual-bean spring clamp bean. By means of elastic locking cooperation design of the spring clamp beans and the lock holes, the corresponding butt-joint and fixed installation of the above components are facilitated.

Figure 20:
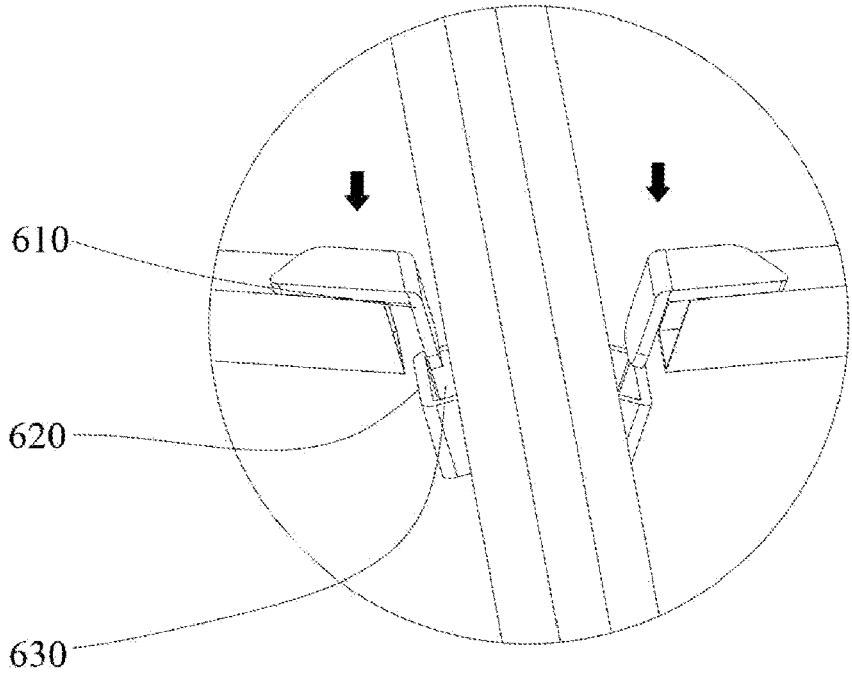
FIG. 20 is a seventh schematic structural diagram of the buckle mechanism in the present disclosure.
Figure 21:
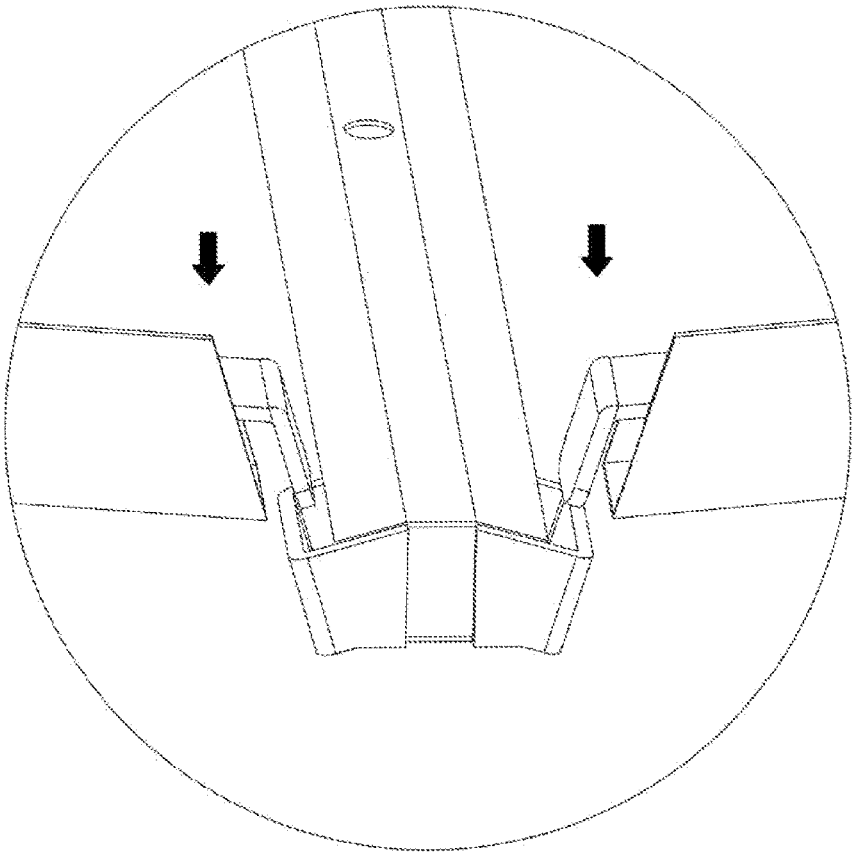
FIG. 21 is an eighth schematic structural diagram of the buckle mechanism in the present disclosure.

In one of the embodiments, as shown in FIG. 20 to FIG. 21, the buckle piece 610 is fixedly matched with an end part of the first component, the buckle piece 610 adopts an inverted L-shaped clamp plate, and the buckle piece 610 is buckled into the lock hole 630 from top to bottom. By means of buckling and locking cooperation design of the buckle piece 610, namely, the inverted L-shaped clamp plate and the lock hole 630, the corresponding butt-joint and fixed installation of the above components are facilitated.

Figure 22:
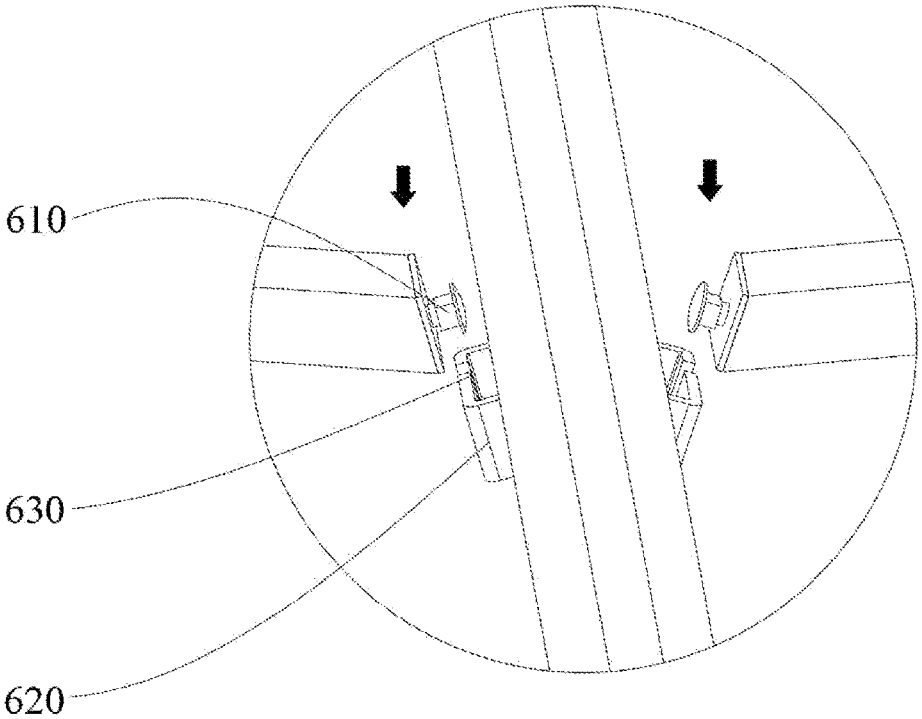
FIG. 22 is a ninth schematic structural diagram of the buckle mechanism in the present disclosure.
Figure 23:
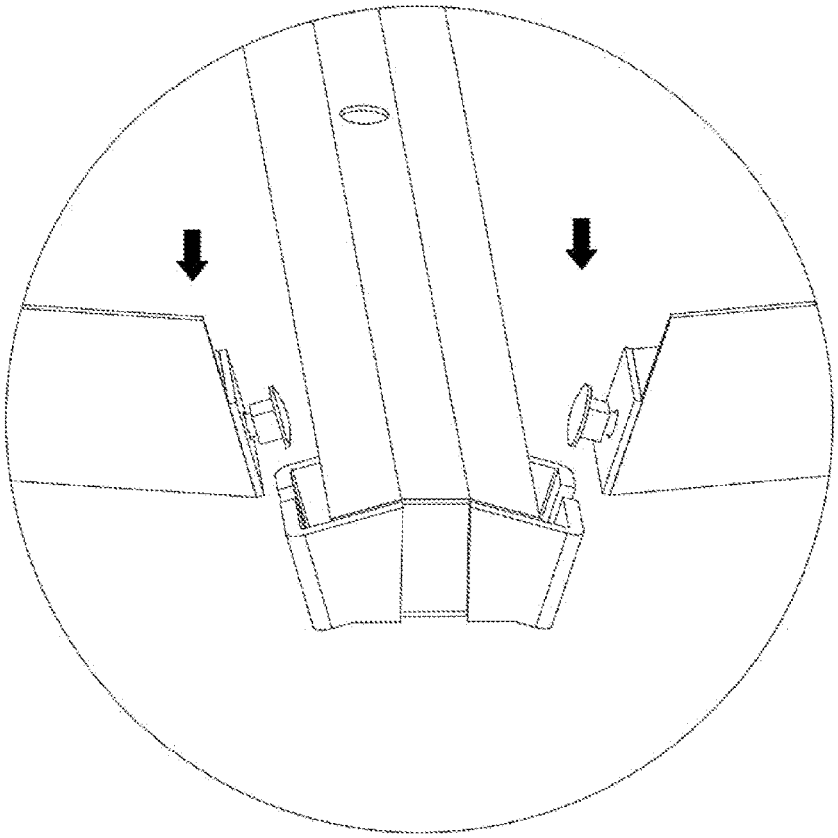
FIG. 23 is a tenth schematic structural diagram of the buckle mechanism in the present disclosure.

In one of the embodiments, as shown in FIGS. 22 and 23, the buckle piece 610 is fixedly matched with the end part of the first component, the buckle piece 610 adopts a T-shaped buckle, and the buckle piece 610 is buckled into the lock hole 630 from top to bottom. By means of buckling and locking cooperation design of the buckle piece 610, namely, the T-shaped buckle and the lock hole 630, the corresponding butt-joint and fixed installation of the above components are facilitated.

Figure 24:
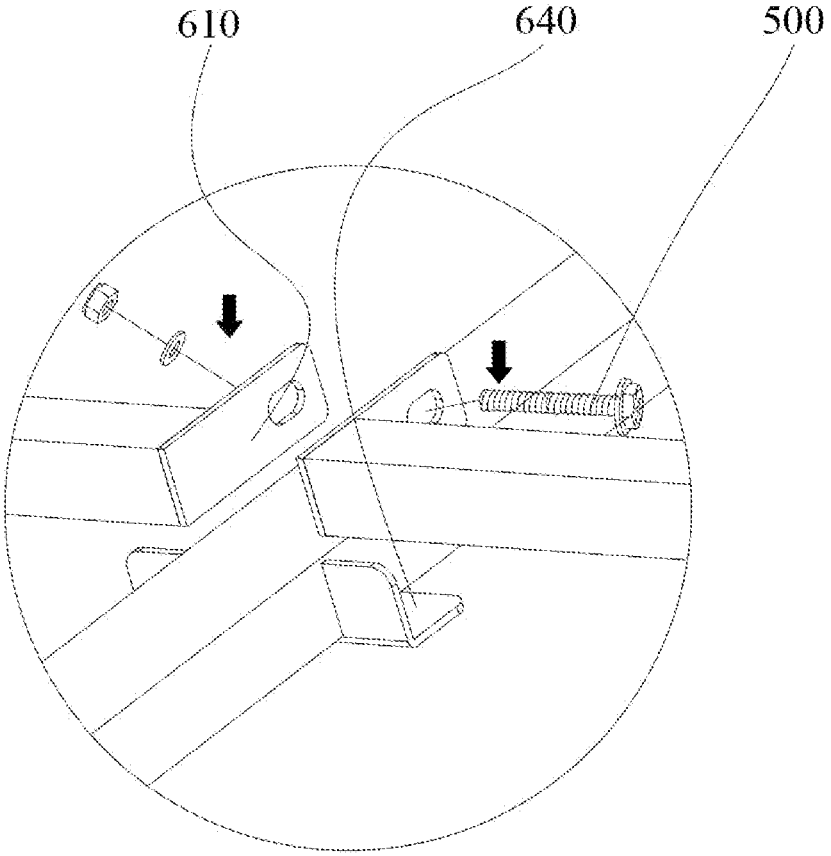
FIG. 24 is an eleventh schematic structural diagram of a buckle mechanism in the present disclosure.

In one of the embodiments, as shown in FIG. 24, the buckle piece 610 is fixedly matched with the end part of the first component, the buckle piece 610 adopts a locking plate, the lock hole in the buckle seat 620 adopts a structure of a support groove 640, the support groove 640 is configured to support the first component, and the locking plate and the second component are fixedly installed via a fastener 500. The components are supported by means of the support grooves 640 and are fixed in combination with fasteners 500 and the lock holes, which facilitates the corresponding butt-joint and fixed installation of the above components.

Figure 12:
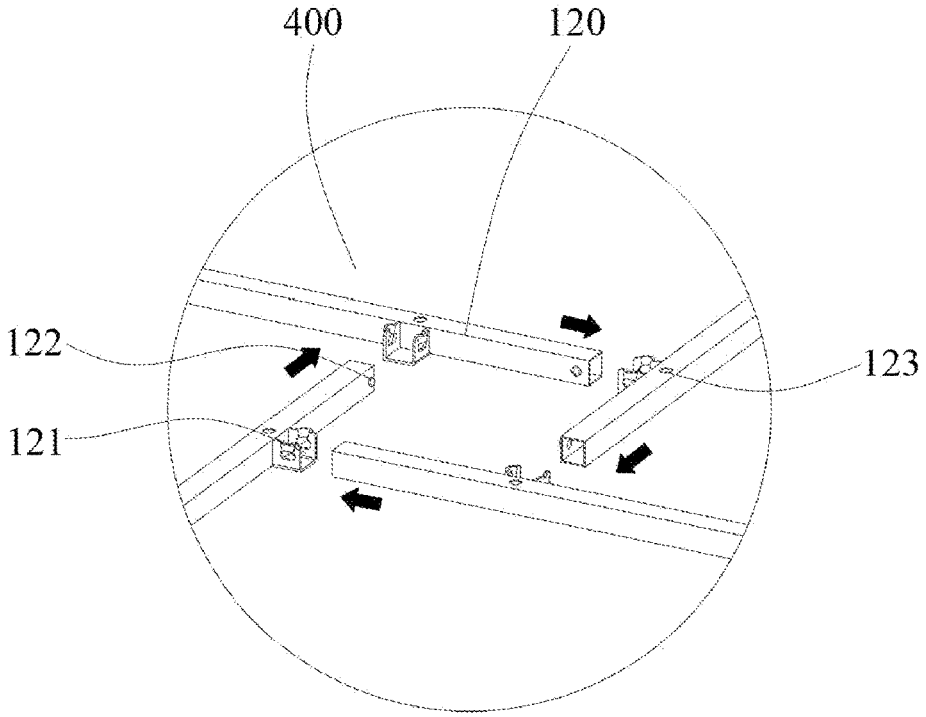
FIG. 12 is a first schematic structural diagram of the auxiliary stand column bracket in the present disclosure.

In combination with the above structure, as shown in FIG. 12, in the construction of the auxiliary stand column bracket 400, rapid installation, especially butt-joint of the first assembly portion 121 and the second assembly portion 122 may be realized by means of the above-mentioned buckle mechanism 600 to complete the installation of the auxiliary stand column bracket 400, where the cooperation of the spring clamp bean and the lock hole is preferably adopted.

Figure 13:
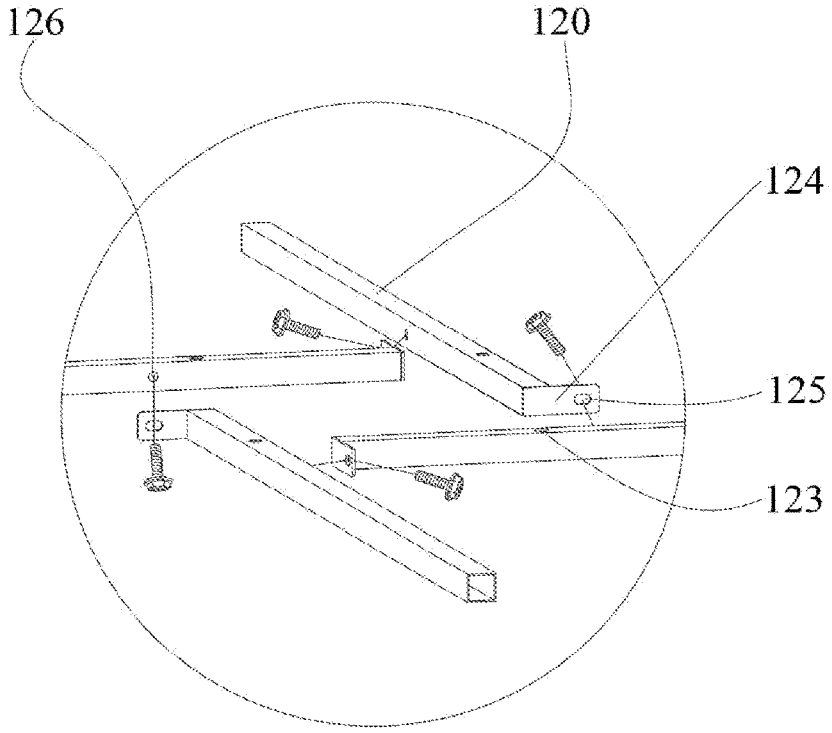
FIG. 13 is a second schematic structural diagram of the auxiliary stand column bracket in the present disclosure.
Figure 14:
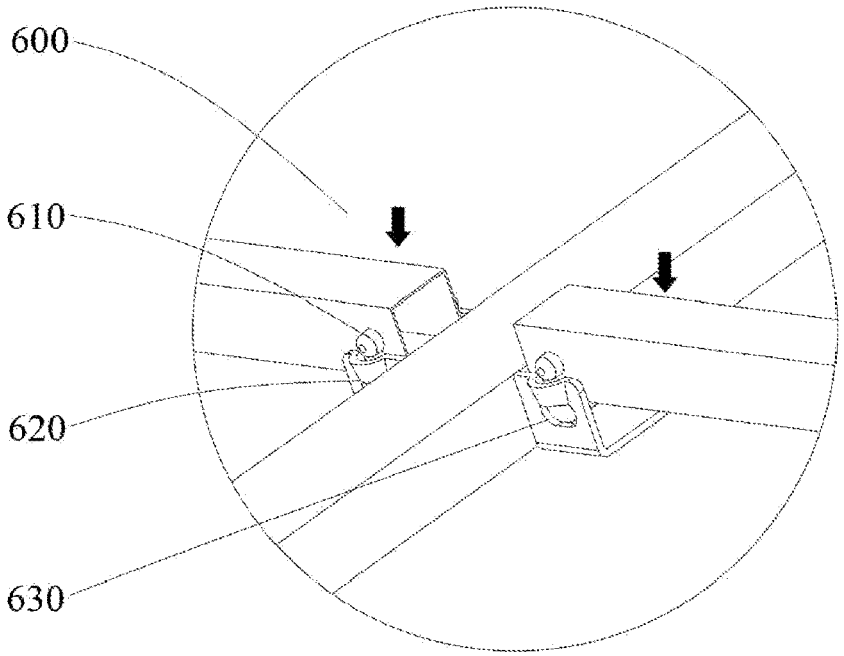
FIG. 14 is a first schematic structural diagram of a buckle mechanism in the present disclosure.
Figure 15:
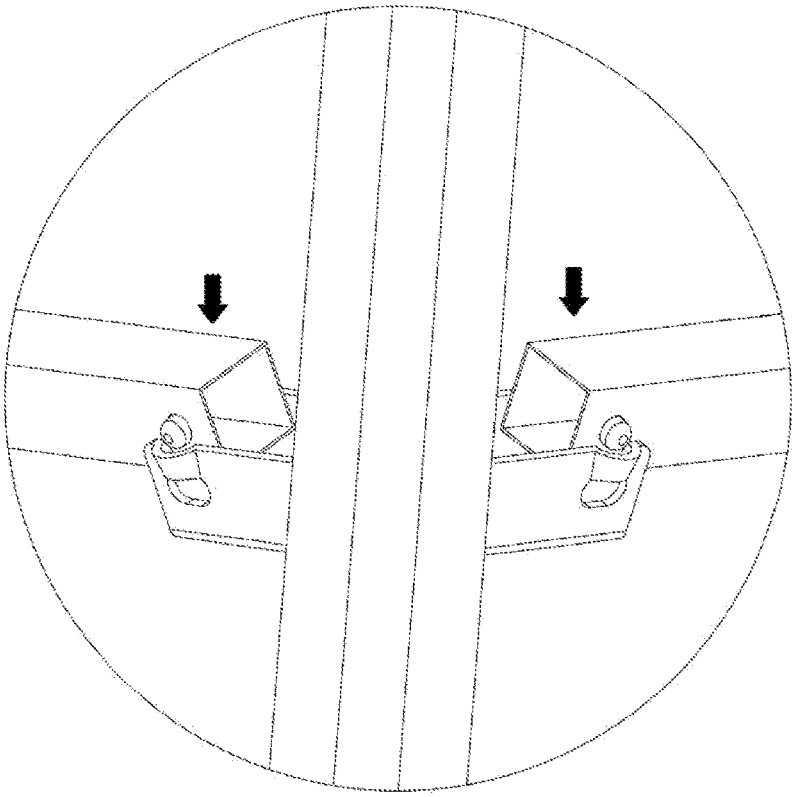
FIG. 15 is a second schematic structural diagram of the buckle mechanism in the present disclosure.
Figure 16:
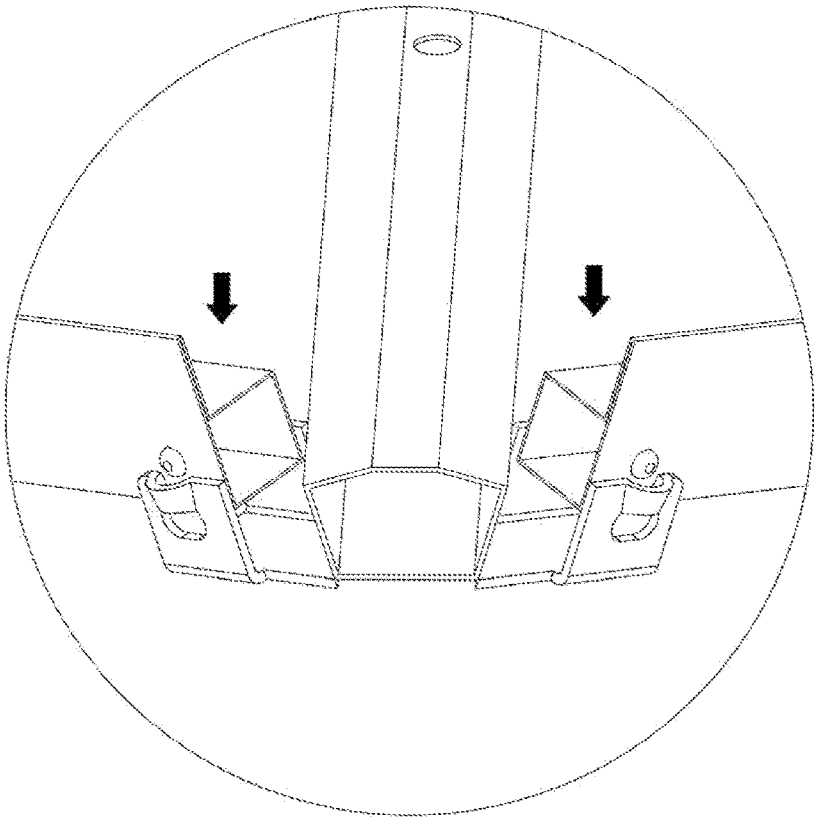
FIG. 16 is a third schematic structural diagram of the buckle mechanism in the present disclosure.
Figure 17:
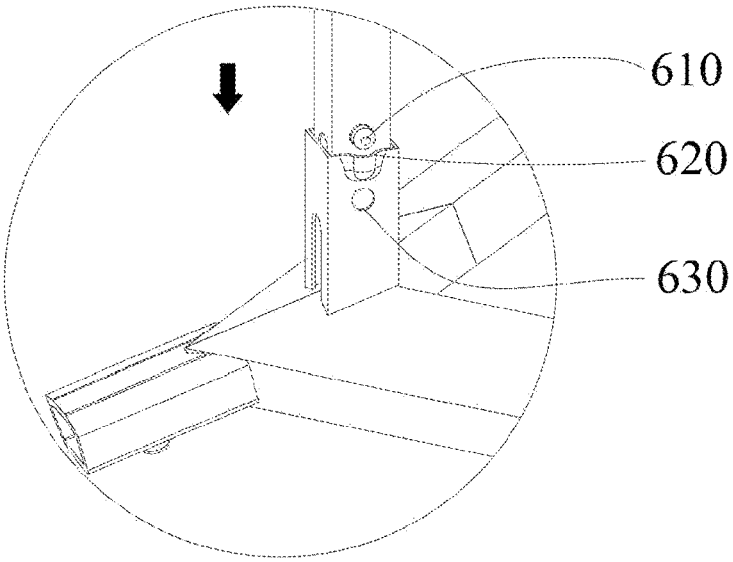
FIG. 17 is a fourth schematic structural diagram of the buckle mechanism in the present disclosure.
Figure 18:
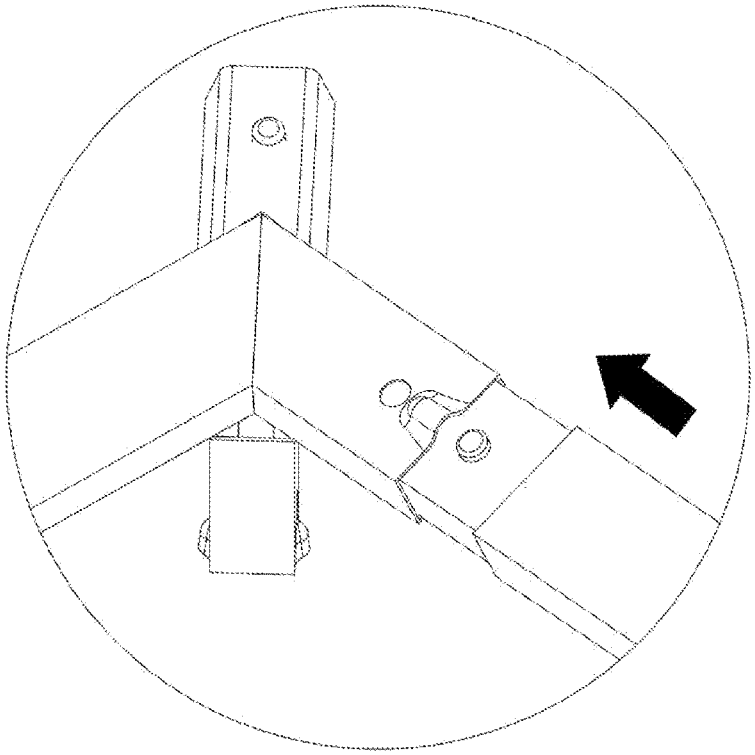
FIG. 18 is a fifth schematic structural diagram of the buckle mechanism in the present disclosure.
Figure 19:
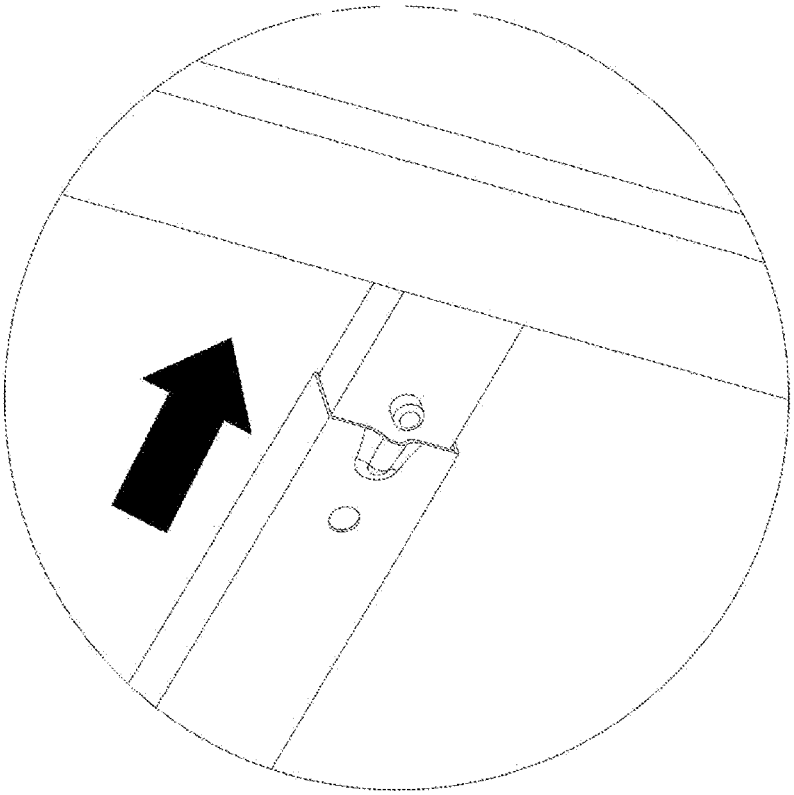
FIG. 19 is a sixth schematic structural diagram of the buckle mechanism in the present disclosure.

In another embodiment, as shown in FIG. 13, an end face fixing plate 124 is arranged at an end part of each tent beam skeleton 120, an assembly installation hole 125 is formed in the end face fixing plate 124, and the assembly installation hole 125 is butted and fixed with a tent beam skeleton assembly hole 126 by means of a fastener 500 to realize cooperative fixation of positions so as to complete the installation of the auxiliary stand column bracket 400.

In this embodiment, by optimizing the buckle mechanism, rapid combination and installation of the components are facilitated, and the convenience of independent building is improved. The components are of an independently assemblable structure, which makes the product convenient to independently build.

Embodiment 3

Based on any one of the above embodiments, this embodiment discloses a convenient assembly method for an outdoor fixed tent adopting buckle mechanisms, and the assembly method includes the following specific steps.

Step S1: Construction of auxiliary stand column brackets 400. Constructing the same number of auxiliary stand column brackets 400 by the number of corresponding stand columns 210 according to the specification of an outdoor fixed tent needing to be constructed, where four tent beam skeletons 120 are selected for a single auxiliary stand column bracket 400, and first assembly portions 121 and second assembly portions 122 are butted via buckle mechanisms 600 to complete the installation of the auxiliary stand column brackets 400.

Step S2: Fixation of the stand columns 210. Completing fixed installation of stand column bases 260 at the bottoms of the stand columns 210 and the auxiliary stand column brackets 400 via fasteners 500, and placing the plurality of stand columns 210 in corresponding positions according to the corresponding specification of the outdoor fixed tent.

Step S3: Construction of cross beams 230. Fixedly installing a single cross beam 230, respectively fixing outer cross beams and inner cross beams in a butted manner, fixedly installing hanging frames 250 on the cross beams 230, allowing the cross beams to be in hanging cooperation with hanging seats 222 in installation seats 220 on the stand columns 210 via the hanging frames 250, and fixedly installing the cross beams 230 and the stand columns 210 via fasteners 500.

Step S4: Construction of a tent roof 100. The step S4 includes step S41 and step S42. Step S41: restoration of the tent beam skeletons 120, which includes removing the fixed installation of the auxiliary stand column brackets 400 and the stand column bases 260, and removing buckle mechanisms 600 between the auxiliary stand column brackets 400 to restore the auxiliary stand column brackets to the independent tent beam skeletons 120. Step S42: fixing the corresponding tent beam skeletons 120 and roof tent skeletons 110 in a butted manner via buckle mechanisms 600 according to the specification of the outdoor fixed tent to complete the construction of the tent roof 100.

Step S5: Construction of the tent roof 100 and a tent frame 200. Fixing the roof tent skeletons 110 in the tent roof 100 to first tent rod brackets 221 or/and second tent rod brackets 240 via fasteners 500 to complete the construction, where diagonal tent skeletons 111 are configured to be installed in cooperation with the first tent rod brackets 221, and middle tent skeletons 112 are configured to be installed in cooperation with the second tent rod brackets 240.

Step S6: Construction of tent roof plates. Covering the tent roof 100 with the tent roof plates at corresponding positions and performing fixation via fasteners 500 to complete the construction of the whole tent.

In one of the preferred embodiments, if the tent roof 100 is designed to be of a double-roof structure, then in the step S4, the construction of an upper tent roof 300 is added, where a central tent frame 130 is constructed, and third assembly portions 133 are respectively fixedly matched with diagonal tent skeletons 111, vertical rods 330, and butt-joint frames 132 via buckle mechanisms 600. Upper tent roof skeletons 320 are butted and matched with upper tent beam skeletons 340 via buckle mechanisms 600.

The above are only preferred embodiments of the present disclosure and are not intended to limit the present disclosure in any form. Any simple modifications, equivalent changes, or modifications made to the above embodiments in accordance with the technical principle of the present disclosure still fall within the scope of the technical solution of the present disclosure.

What is claimed is:

1. An outdoor fixed tent with an assembly structure, the outdoor fixed tent comprising:

a tent roof and a tent frame, the tent roof being installed at an upper part of the tent frame in a covering manner, wherein the tent roof comprises a plurality of roof tent skeletons and a plurality of tent beam skeletons, each of the roof tent skeletons has one end configured to cooperate with the tent frame and the other end extending towards a center of the tent roof and being inclined upwards, the plurality of tent beam skeletons are arranged transversely, at least one end of each of the tent beam skeletons is configured to cooperate with a corresponding said roof tent skeleton, the tent beam skeletons at a same horizontal height are constructed to form a horizontal frame, and at least two said horizontal frames are positioned at different horizontal heights; and the tent frame comprises a plurality of stand columns and a cross beam connected between adjacent two of the stand columns, an installation seat is arranged at an upper end of each of the stand columns, and two ends of the cross beam are respectively installed in cooperation with corresponding said installation seats, wherein each installation seat comprises a first tent rod bracket and a hanging seat configured to be installed in cooperation with the cross beam, and the cross beam is in hanging cooperation with the hanging seat via a hanging frame, and the first tent rod bracket comprises a first bracket rod and a first inclined groove positioned in an upper part of the first bracket rod, wherein the hanging frame comprises a hook portion, a main body portion, and a bottom support portion, the hook portion is configured to be in hanging cooperation with the hanging seat, the main body portion is configured to be fixedly matched with at least one of a corresponding said stand column or the cross beam, and the bottom support portion is configured to support the cross beam, wherein the cross beam comprises an outer cross beam and an inner cross beam, the outer cross beam comprises a first outer cross beam unit and a second outer cross beam unit, the inner cross beam comprises a central inner cross beam and side inner cross beam positioned at two ends of the central inner cross beam, the first outer cross beam unit and the second outer cross beam unit are butted and matched with each other, the central inner cross beam is arranged correspondingly with a butt-joint position of the first outer cross beam unit and the second outer cross beam unit as a center, and the two ends of the central inner cross beam are respectively matched with one end of the side inner cross beam, and further including second tent rod brackets, wherein each of the second tent rod brackets comprises a bracket seat and a second inclined groove positioned in an upper part of the bracket seat, a bottom portion of the bracket seat is configured to be fixedly matched with a respective said cross beam, and the second tent rod bracket is positioned at the butt-joint position of the first outer cross beam unit and the second outer cross beam unit, wherein the roof tent skeletons are diagonal tent skeletons, the diagonal tent skeletons are radiated from the center of the tent roof to the stand columns, and the roof tent skeletons are configured to cooperate with the first inclined grooves, wherein the roof tent skeletons further comprise middle tent skeletons, the middle tent skeletons are radiated from the center of the tent roof to middles of the cross beams, and the middle tent skeletons are configured to cooperate with the second inclined grooves.

2. The outdoor fixed tent according to claim 1, wherein any four of the tent beam skeletons or any four of the tent beam skeletons positioned in a same one of the horizontal frames are combined to form an auxiliary stand column bracket.

3. The outdoor fixed tent according to claim 2, wherein each of the tent beam skeletons has one end provided with a first assembly portion and an end part provided with a second assembly portion, the first assembly portion is able to be butted and matched with the second assembly portion at the end part of another tent beam skeleton, the four tent beam skeletons are correspondingly butted and matched to form the auxiliary stand column bracket, stand column butt-joint holes are further correspondingly formed in the tent beam skeletons, a stand column base is arranged at a bottom portion of each of the stand columns, a stand column installation hole is formed in the stand column base, and the stand column installation hole is able to be fixedly matched with the corresponding stand column butt-joint hole via a fastener.

4. The outdoor fixed tent according to claim 1, wherein a central tent frame is arranged in the center of the tent roof, and an upper tent roof is cooperatively arranged on the central tent frame via vertical rods.

5. The outdoor fixed tent according to claim 4, wherein the upper tent roof comprises a central tent roof cover, a plurality of upper tent roof skeletons extending towards a periphery from the central tent roof cover, and upper tent beam skeletons installed at extension ends of the adjacent upper tent roof skeletons, two ends of each of the upper tent beam skeletons are installed in cooperation with the adjacent upper tent roof skeletons, and upper ends of the vertical rods are fixedly matched with middles of the upper tent roof skeletons.

6. The outdoor fixed tent according to claim 5, wherein the central tent frame comprises assembly frames and butt-joint frames, a third assembly portion is arranged at an end part of each of the assembly frames, and the diagonal tent skeletons, the vertical rods, and the butt-joint frames are fixed to the third assembly portions; and a fourth assembly portion is arranged on an outer side of a middle portion of each of the assembly frames, and the fourth assembly portion is configured to be cooperatively fixed to an end part of the corresponding middle tent skeleton.

7. The outdoor fixed tent according to claim 1, further including a buckle mechanism comprising a first component and a second component, wherein the first component and the second component are cooperatively installed via the buckle mechanism, the buckle mechanism comprises a buckle piece and a buckle seat, the first component is a rod piece with a hollow inner cavity structure, the buckle piece is cooperatively arranged in an inner cavity at an end part of the first component or a position adjacent to the end part of the first component, and the buckle seat is arranged on the second component.

8. The outdoor fixed tent according to claim 7, wherein a lock hole configured to be fixed to the buckle piece is formed in the buckle seat.

9. The outdoor fixed tent according to claim 8, wherein when one lock hole is in the buckle seat, the buckle piece matched with a corresponding buckle adopts a single-bean spring clamp bean; and when two lock holes are in the buckle seat, the buckle piece matched with the corresponding buckle adopts a dual-bean spring clamp bean.

10. The outdoor fixed tent according to claim 8, wherein the buckle piece is fixedly matched with the end part of the first component, the buckle piece adopts an inverted L-shaped clamp plate or a T-shaped buckle, and the buckle piece is buckled into the lock hole from top to bottom.

11. The outdoor fixed tent according to claim 8, wherein the buckle piece is fixedly matched with the end part of the first component, the buckle piece adopts a locking plate, the lock hole in the buckle seat adopts a structure of a support groove, the support groove is configured to support the first component, and the locking plate and the second component are fixedly installed via a fastener.

12. A method of assembling the outdoor fixed tent according to claim 1, the method comprising the following steps:

step S1: construction of auxiliary stand column brackets: constructing a same number of auxiliary stand column brackets by number of corresponding stand columns according to a specification of an outdoor fixed tent needing to be constructed, wherein four tent beam skeletons are selected for a single auxiliary stand column bracket, and first assembly portions and second assembly portions are butted via buckle mechanisms to complete an installation of the auxiliary stand column brackets;

step S2: fixation of the stand columns: completing fixed installation of stand column bases at bottoms of the stand columns and the auxiliary stand column brackets via fasteners, and placing the plurality of stand columns in corresponding positions according to the corresponding specification of the outdoor fixed tent;

step S3: construction of cross beams: fixedly installing a single cross beam, respectively fixing outer cross beams and inner cross beams in a butted manner, fixedly installing hanging frames on the cross beams, allowing the cross beams to be in hanging cooperation with hanging seats in installation seats on the stand columns via the hanging frames, and fixedly installing the cross beams and the stand columns via fasteners;

step S4: construction of a tent roof, including:

step S41: restoration of the tent beam skeletons: removing the fixed installation of the auxiliary stand column brackets and the stand column bases, and removing buckle mechanisms between the auxiliary stand column brackets to restore the auxiliary stand column brackets to the independent tent beam skeletons; and step S42: fixing the corresponding tent beam skeletons and roof tent skeletons in a butted manner via buckle mechanisms according to the specification of the outdoor fixed tent to complete the construction of the tent roof;

step S5: construction of the tent roof and a tent frame: fixing the roof tent skeletons in the tent roof to at least one of first tent rod brackets or second tent rod brackets via fasteners to complete the construction; and step S6: construction of tent roof plates: covering the tent roof with the tent roof plates at corresponding positions and performing fixation via fasteners to complete construction of the outdoor tent.

13. The method according to claim 12, wherein the step S4 further comprises construction of an upper tent roof, wherein a central tent frame is constructed, and third assembly portions are respectively fixedly matched with diagonal tent skeletons, vertical rods, and butt-joint frames via buckle mechanisms; and upper tent roof skeletons are butted and matched with upper tent beam skeletons via buckle mechanisms.

* * * * *